US005928021A

United States Patent [19]

Koch

[11] Patent Number: 5,928,021

[45] Date of Patent: Jul. 27, 1999

[54] ELECTRICAL CONNECTOR WITH INTERNAL SWITCH AND MATING CONNECTOR THEREFOR

[75] Inventor: Richard M. Koch, Wakefield, Mass.

[73] Assignee: Tru-Connector Corporation, Peabody, Mass.

[21] Appl. No.: 09/047,006

[22] Filed: Mar. 24, 1998

Related U.S. Application Data

[60] Provisional application No. 60/053,830, Jul. 29, 1997.

[51] Int. Cl.[6] ..... H01R 13/703

[52] U.S. Cl. ..... 439/188; 200/51.09

[58] Field of Search ..... 439/188; 200/51.09

[56] References Cited

U.S. PATENT DOCUMENTS

| | | | |
|---|---|---|---|
| 3,496,500 | 2/1970 | Romary | 200/51.09 |
| 3,801,757 | 4/1974 | Carissimi et al. | 200/51.09 |
| 3,902,120 | 8/1975 | Dascal et al. | 200/51.09 |
| 3,944,316 | 3/1976 | Newman et al. | 200/51.09 |
| 4,044,208 | 8/1977 | McDonald et al. | 200/51.09 |

OTHER PUBLICATIONS

Tru–Connector product description for "Type SQ RF Connectors" dated Jun. 6, 1994; 2 pages.

*Primary Examiner*—Neil Abrams

*Attorney, Agent, or Firm*—Donald J. Perreault

[57] ABSTRACT

An electrical connector (1) including a body (2) and a switch (10) disposed within an annular cavity (180) in the body and adjacent an annular opening (184) in the body. The switch has leads (162,164) connected to an electric circuit for controlling connection of an electrical signal to a center conductor of the connector. The body includes a bore (161) therein leading from an exterior surface of the body to the annular cavity. The bore is adapted in size to receive conductors (162,164) connected to the leads of the switch (10). The conductors connect the switch leads to the electric circuit for controlling application of the electrical signal to the center conductor (18) of the connector. Upon mating of the connector with a mating connector (64), a switch actuating portion (262) of the mating connector causes the switch (10) to change from a normally open state, wherein connection of the electrical signal to the center conductor (18) is interrupted, to a closed state, wherein the electrical signal is connected to the center conductor for allowing current flow through the center conductor to a center conductor of the mating connector. A method of connecting of an electrical signal to an electrical connector upon mating of the connector with the mating connector is also disclosed.

18 Claims, 5 Drawing Sheets

ELECTRICAL CONNECTOR WITH INTERNAL SWITCH AND MATING CONNECTOR THEREFOR

CROSS-REFERENCE TO RELATED APPLICATIONS

The present application is based, in part, on U.S. Provisional Application Ser. No. 60/053,830 filed Jul. 29, 1997, the teachings of which are incorporated herein by reference.

FIELD OF THE INVENTION

The present invention relates in general to electrical connectors, and in particular to an electrical connector having an internal switch for closing an electrical current path upon connection of a mating connector.

BACKGROUND OF THE INVENTION

In high frequency and high power electrical applications, the application of power to associated equipment involves inherent risks which are of a constant concern to both manufacturers and users of such equipment. Power must be applied in a manner which will not damage the equipment, and in a manner which provides a safe environment for users. For example, when high power (i.e., kilowatts) RF signals are transmitted along a cable which is disconnected from a load, i.e. on an open circuit, the energy may be reflected back to the signal source, thereby destroying the same. Also, if conducting material is in close proximity to the end of the cable through which the high power signal is applied, the signal may arc across an air gap to the conducting material. This could cause serious risks of electrical shock, equipment damage, fire, etc.

Another concern relates to the risk of electrical shock to the users of the high power equipment. When power is applied along a cable which is disconnected from a load, it is possible that a user could come into physical contact with the "hot" end of the cable. This can occur, for example, through the inadvertent direct contact with the center conductor of the cable, or by inadvertent contact of a hand tool with the center conductor. Regardless of the manner of contact, however, sufficient power to seriously injure or kill a person can be applied to the cable. Prevention of contact with the center conductor of the cable is, therefore, of extreme importance.

Unfortunately, users of high-power RF equipment have generally been left to their own resources to limit the risks associated with the application of a high power signal to an open circuit. Most users are highly cognizant of the risks, and are careful to connect a load to a signal source before applying power. Human error, inexperience and accident, however, frequently result in serious injury to users and damage to equipment.

There is, therefore, a long felt need in the art for simple and efficient mechanical means for ensuring that an electrical signal source is not applied to an open circuit. In particular, there is a need in the art for an electrical connector, especially a connector for use in high power RF applications, having an internal switch for allowing connection of an electrical source to a conductor path only when a mating connector is mated therewith.

OBJECTS OF THE INVENTION

Accordingly, a primary object of the present invention is to provide an electrical connector having an internal switch for allowing connection of an electrical signal source to a conductor path only when a mating connector is mated therewith.

Another object of the present invention is to provide an electrical connector having a switch actuating portion for tripping a internal switch on a mating connector thereby allowing connection of an electrical source to a conductor path only when a mating connector is mated therewith.

Another object of the present invention is to provide an electrical connector having an internal switch for allowing connection of an electrical source to a conductor path only when a mating connector is mated therewith to thereby complete the conductor path, wherein the internal switch cannot easily be closed by contact of the switch with a blunt object such as a human finger.

Still another object of the present invention is to provide an electrical connector which reduces the hazard of inadvertent shock associated with high power electrical applications.

A further object of the present invention is to provide an electrical connector with an internal switch which is of a simple and cost efficient design.

Yet a further object of the present invention is to provide an electrical connector with an internal switch which is easily assembled.

Still a further object of the present invention is to provide a novel method of preventing connection of an electrical signal source to an open circuit using a connector having an internal switch.

These and other objects of the present invention will become apparent from a review of the description provided below.

SUMMARY OF THE INVENTION

The electrical connector of the present invention is organized about the concept of providing a connector having an internal switch which is tripped by a switch actuating portion of a mating connector when the mating connector is mated therewith. The switch closes a normally open electrical path for controlling application of power through the connector. Thus, when the connector of the present invention is connected to a mating connector according to the invention, i.e., when a load is connected to the signal source, the signal source is switched to the connector by the contact of a switch actuating portion of the mating connector with the internal switch. When the mating connector is removed, the switch actuating portion thereof withdraws from the switch to return the switch to its normally open state and to disconnect the signal source from the connector. A signal can be provided from the signal source to the connector, therefore, only when a mating connector is mated with the connector of the invention. Advantageously, all risks of personal injury and damage to equipment are eliminated.

Specifically, the connector of the present invention includes a body, and a switch disposed within a cavity in the body. The switch has leads connected to an electric circuit for controlling connection of an electrical signal to a center conductor of the connector. Upon mating of the connector with a mating connector, the mating connector causes the switch to change from a normally open state, wherein connection of the electrical signal to the center conductor is interrupted, to a closed state, wherein the electrical signal is connected to the center conductor for allowing current flow through the center conductor to a center conductor of the mating connector.

Preferably, the switch is disposed within the cavity adjacent an opening in the body so that a portion of the mating connector may enter the opening and directly contact the switch to change the switch from its normally open state to the closed state. The switch may, however, contact another element(s) which travels axially to trip the switch. The switch may be of many varieties, and the mating connector may contact any necessary portion of the switch to change the switch state, e.g. the mating connector may contact a post of the switch, or may toggle a switch arm.

The body includes a bore therein leading from an exterior surface of the body to the cavity. The bore is adapted in size to receive conductors connected to the leads of the switch. The conductors connect the switch leads to the electric circuit for controlling application of the electrical signal to the center conductor.

In a preferred embodiment, the body includes a mating shell and an outer shell, and the cavity in which the switch is disposed is formed between the mating shell and the outer shell. The mating shell preferably includes a projection thereon for mounting the switch. The switch is secured to the mating shell by engagement of threads on an interior surface of the projection and threads on an exterior surface of a portion of the switch.

The mating connector has a body with a switch actuating portion. The switch actuating portion is dimensioned to extend axially from the body to contact the switch upon mating of the mating connector with the connector. Preferably, the body of the mating connector includes an inner shell portion and a coupling shell disposed about the inner shell. The coupling shell is axially biased toward a mating end of the mating connector by a compression spring disposed between the inner shell and the coupling shell. In this preferred embodiment, the end of the coupling shell is the switch actuating portion for contacting the switch.

The inner shell preferably includes portions defining openings, and locking elements are disposed within the openings with portions thereof being forced radially inward beyond an inner surface of the inner shell by a first surface of the coupling shell. The coupling shell includes a beveled surface adjacent to the first surface. Upon axial movement of the coupling shell away from the mating end, the beveled surface aligns with the openings thereby allowing the locking elements to recede within the openings against the beveled surface.

The connector includes a groove formed therein for receiving the locking elements of the mating connector. The locking elements are forced into the groove by the first surface upon release of the coupling shell for thereby forming a mating connection between the mating connector and the connector.

The invention further includes a method of connecting of an electrical signal to an electrical connector upon mating of the connector with a mating connector. The method includes providing an electrical connector according to the invention and mating it with a mating connector so that a center conductor of the mating connector contacts a center conductor of the connector and the mating connector trips the switch to change the switch from its normally open state to a closed state.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

The present invention will now be described in connection with a preferred embodiment which is adapted to mount to an instrument panel, or the like, for making a removable electrical connection between an electrical signal source and an electrical device. Advantageously, the connector includes a switch which trips an external switch for controlling the flow of current through the connector in dependence of whether a mating connector is secured to the connector. For ease of explanation, the invention will be described herein in connection with a particular preferred embodiment. Those skilled in the art will recognize, however, that the advantages of the invention could be incorporated into many connector designs. It is intended, therefore, that the invention not be limited to the specific embodiment described, but include any variation thereof associated with use in varied connector schemes and designs.

Figure 1:
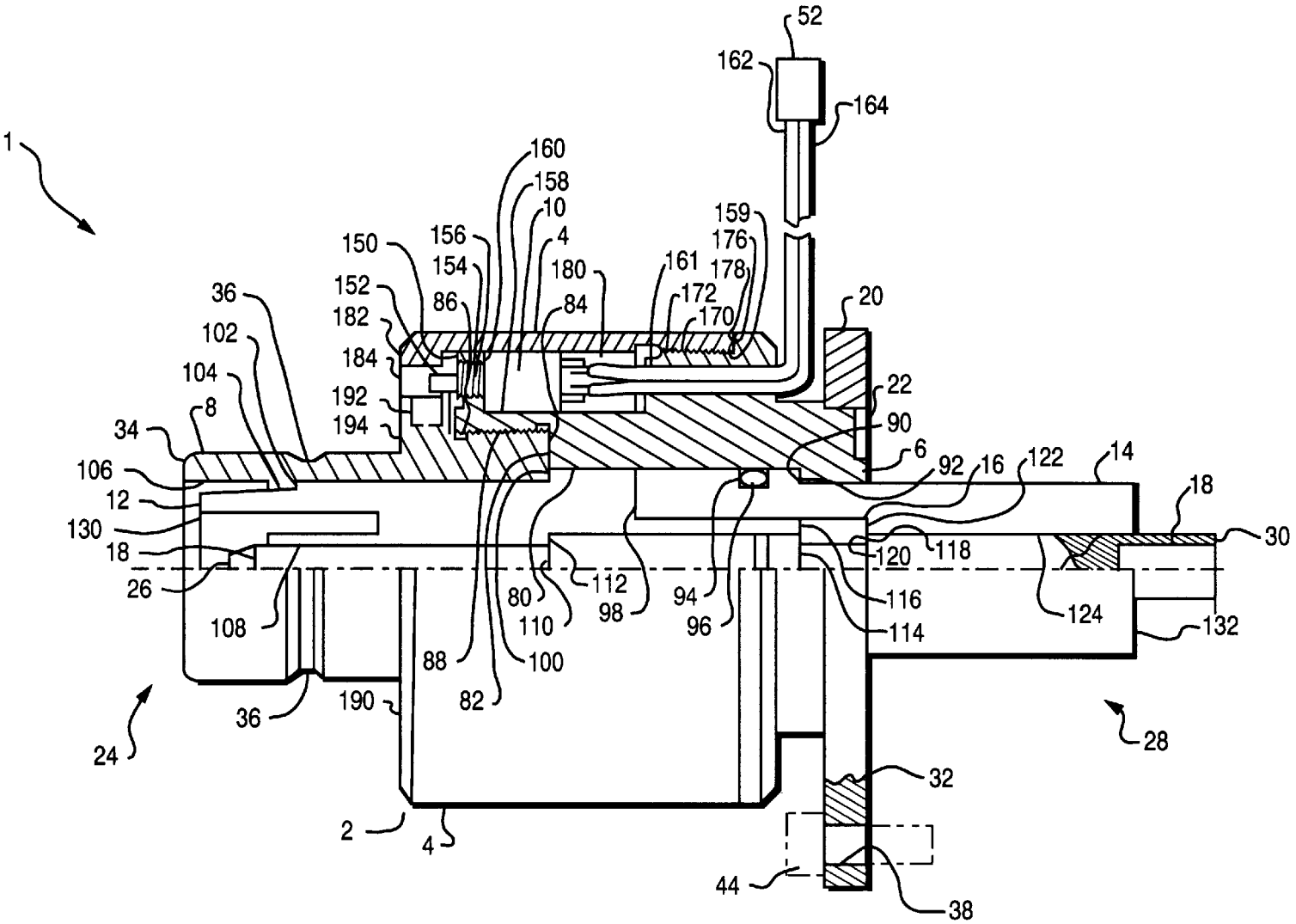
FIG. 1: is a partial sectional view of a preferred connector according to the present invention.
Figure 2:
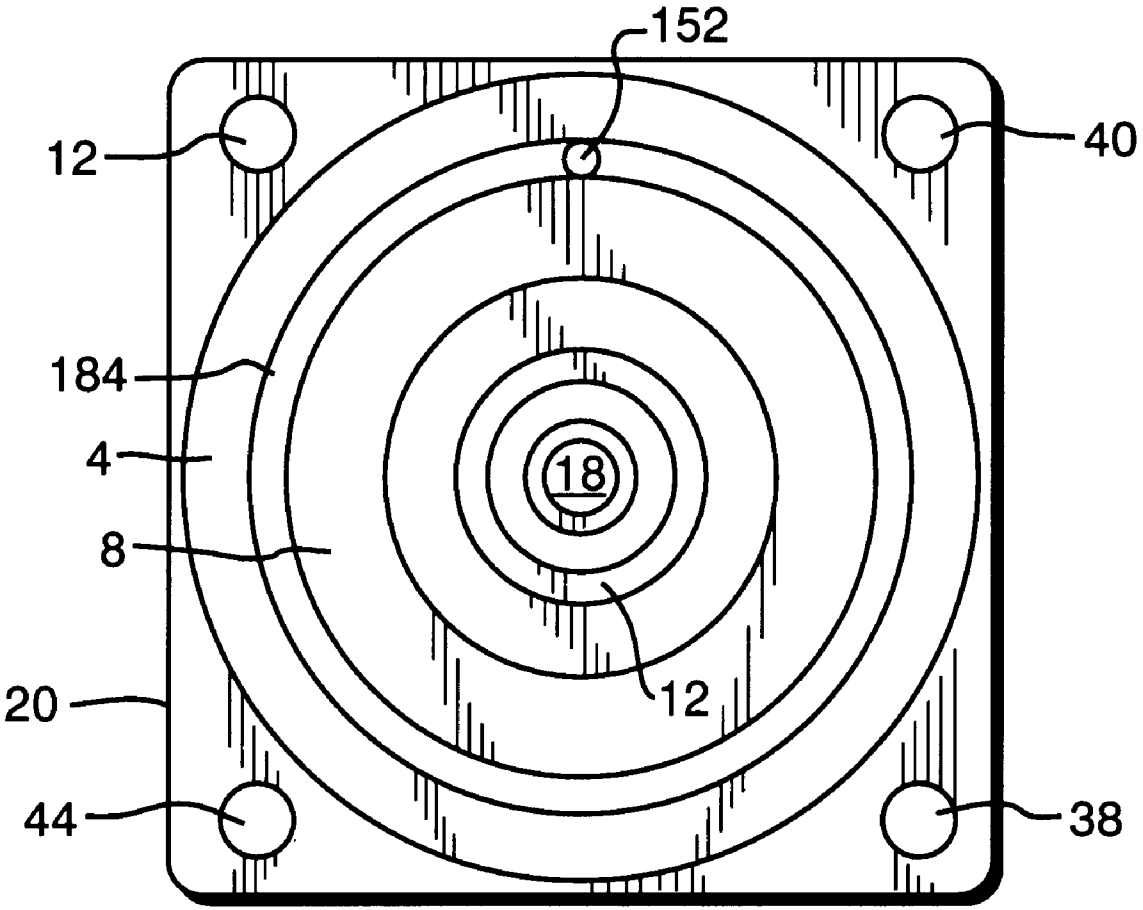
FIG. 2: is an end view of the connector of FIG. 1.

Turning to FIGS. 1–2, a preferred embodiment of the connector 1 generally includes: a connector body 2 including an outer shell 4, a mating shell 6, and an end shell 8; a micro switch 10 disposed within the connector body 2; first 12, second 14, and third 16 insulator portions; a center conductor 18; a mounting plate 20; and a gasket 22. The outer shell, mating shell, end shell and mounting plate are preferably machined from brass and plated with nickel. The contact is preferably formed from brass and plated with silver. The insulator portions are preferably formed from a known insulating material such as TEFLON.

At a plug end 28 of the connector, the end 30 of the center conductor 18 is positioned axially outward from the bottom surface 32 of the mounting plate 20 to facilitate the formation of an electrical connection 58 between an electric signal source 50 (FIG. 5) and the end 30 of the center conductor, e.g. by connection with a mating connector 52 or by soldering of an appropriate conductors 54,56. At a receptacle end 24 of the connector, the end 26 of the center conductor 18 is positioned axially inward relative to the top surface 34 of the end shell 8.

As will be described in detail below, the end shell 8 at the receptacle end 24 is provided with an annular groove 36 for matingly engaging locking elements 60,62, of a mating connector 64 (FIGS. 4 and 5) to create an electrical connection 66 between the center conductor 18 and an electrical device 68 through a center conductor 70 of the mating connector. It is to be understood, however, that other types of mating connections and methods would be readily apparent to those skilled in the art. For example, instead of the ball locking mechanism of the preferred embodiment, a threaded connection may be used whereby a mating connector including a switch actuating portion is threaded onto the end shell. Other types of connections and connection methods will be readily apparent to those skilled in the art.

As shown particularly in FIG. 1, the mating shell 6 and the mounting plate 20 are preferably formed in two pieces which are secured together, e.g. by brazing. It is also possible, however, to form the mating shell and mounting plate as a single piece. Bores in the mounting plate 38, 40, 42, 44, facilitate mounting of the connector 1 to an instrument panel 72 (FIG. 5) via appropriate fasteners, e.g. screws 44. The annular gasket 22 is formed from a suitable gasketing material and is secured against outer end portion of the mating shell 6, e.g. using an adhesive, for allowing a close fit between the connector 1 and the instrument panel 72.

The mating shell 6 is generally cylindrical in shape with a stepped inner surface 80 defining an axial opening therethrough. A first shelf portion 82 of the inner surface 80 provides a stop for a bottom surface 84 of the end shell 8. An adjacent surface of the mating shell is threaded for establishing a connection between the mating shell 6 and the end shell 8. Threads 86 on the adjacent surface matingly engage corresponding threads 88 on a bottom portion of the end shell 8. The end shell and the mating shell are assembled together, therefore, by rotating the end shell 8 and the mating shell 6 relative to each other until the bottom surface 84 of the end shell contacts the shelf 82 of the mating shell.

A second shelf portion 90 of the mating shell provides a contact surface for a shelf 92 formed in the second insulator portion 14. The contact of the shelf 90 with the shelf 92 on the second insulator portion provides means for positively positioning the second insulator portion relative to the mating shell within the opening therein. The second insulator portion includes a groove 94 on an exterior surface thereof for receiving a gasket 96. The gasket ensures close-fitting contact between the second insulator portion and the mating shell.

The first insulator portion 12 contacts an inner end 98 of the second insulator portion, and includes a first shelf 100 thereon which axially aligns with the shelf 82 on the mating shell and contacts the bottom surface 84 of the end shell when the end shell is secured to the mating shell. A second shelf portion 102 is formed on the first insulator portion 12 to contact an radially inward extending projection 104 on the generally cylindrical inner surface 106 of the end shell. The first and second insulator portions are, therefore, locked in axial position relative to the end shell and mating shell between projection 104, shelf 100 and end portion 84 of the end shell, and shelf 82 and shelf 90 of the mating shell.

The inner surface 108 of the first insulating member defines a stepped cylindrical opening through which the center conductor 18 extends. The center conductor 18 is axially positioned within the opening by engagement of a first shelf 110 on the center conductor and a shelf 112 on the first insulator portion. The third insulator portion 16 secures the center conductor against axial movement relative to the body by contact of a bottom surface thereof with a second shelf 114 of the center conductor and an end 116 of the first insulator portion. A top surface 118 of the third insulator portion is disposed against a third shelf 120 of the center conductor 18 and a first shelf portion 122 on the generally cylindrical inner surface 124 of the second is insulator portion.

Thus, the first, second, and third insulator portions combine with the center conductor to axially position and fix the center conductor relative thereto so that the end 24 of the center conductor is positioned to be axially recessed relative to a receptacle end 130 of the first insulator portion. The opposite end 30 of the center conductor is positioned to axially extend from a plug end 132 of the second insulator portion. The insulators and center conductor are axially positioned relative to the mating and end shells by engagement of the first and second insulator portions against the mating and end shells as described above. Advantageously, this structure provides for ease of assembly and positive positioning of the connector components relative to each other.

With reference still to FIG. 1, the exterior surface of the mating shell is adapted for mounting at least one micro switch 10, which, in the preferred embodiment is a model no. SA1RV20 switch manufactured by Eaton Corporation. In the preferred embodiment, only one micro switch is incorporated for opening and closing a connection between an electric signal source 50 and the center conductor 18 of the connector 1. In an alternative embodiment, however, two or more switches may be incorporated in the design with the leads of the switches wired in series between the electric signal source. This connection would prevent the possibility that one of the switches could be overridden by contact with an instrument thereby connecting the source to the center contact in the absence of a connection with a mating connector. Alternatively, the switch could be connected to separate circuits for opening or closing other conductive paths. In the embodiment with two switches, the switches would be spaced at approximately 180 degrees apart to provide balanced forces acting against the mating connector.

Referring still to FIG. 1, at a first end of the matting shell a radially extending mounting projection 150 is formed having a bore therein through which a post 152 of the micro switch may be passed. The interior surface of the bore is provided with threads 154 which matingly engage corresponding threads on a threaded portion 156 of the switch. The switch is therefore mounted and secured to the mating shell by mating of the threads on the switch and the mounting projection and rotating the switch until the threaded portion of the switch travels through the bore and the end of the body portion 158 of the switch engages the bottom surface 160 of the mounting projection.

At a second end of the mating shell, the shell is formed with an increased diameter portion 159, and a bore 161 is formed through the increased diameter portion. The bore is sized to allow conductor leads 162, 164 to pass from the switch leads and to the exterior or the connector body. The conductor leads allow for connection of the switch in an electrical circuit for electrically opening and closing the conductor path through the center conductor 18. The leads may be provided with an appropriate connector 52 on the ends thereof for allowing facile connection to the electrical circuit, or may be connected directly in the circuit by soldering, as the application requires.

The exterior surface of the reduced diameter portion is provided with threads 170 for matingly engaging corresponding threads 172 on the interior surface of a rear end of the generally cylindrical outer shell 4. The outer shell 4 is, therefore, secured to the mating shell by engagement of the threads and rotating the outer shell relative to the mating shell until the bottom surface 176 of the outer shell engages a first shelf portion 178 on the exterior surface of the mating shell. With the outer shell secured to the mating shell, the switch body is disposed within an annular cavity 180 defined by the mating shell and the outer shell, and the conductor leads of the switch extend outward from the body portion through the bore 160.

The end of the outer shell is provided with a reduced diameter portion 182 which is located axially beyond the mounting projection 150 of the mating shell. This reduced diameter portion, along with annular projection 192 formed on the end shell define an annular opening 184 in which the switch post 152 is disposed when the connector is in an unmated condition. Thus, when the connector is in an unmated position, the switch post extends axially beyond the upper surface of the projection 150, but remains axially recessed in the opening 184 relative to the end surface 190 of the outer shell and an end surface 194 of the annular projection 192 formed on the end shell. Advantageously, this construction protects the switch post from inadvertent contact, thereby preventing accidental actuation of the switch to allow connection of a signal source to the center conductor when the switch is in an unmated condition.

The above described construction allows for facile and efficient assembly for the connector 1. Initially, the first second and third insulator portions are positioned over the center conductor with the shelves 110, 114 engaging the corresponding surfaces on the insulator portions. The end shell is then positioned over the first insulator portion with the projection 104 disposed against the shelf 102. The mating shell with the switch and the mounting plate connected thereto is then mated with the end shell via the meshing engagement of threads 86 and 88. The outer shell is then threaded onto the connector via threads 170,172.

Figure 3:
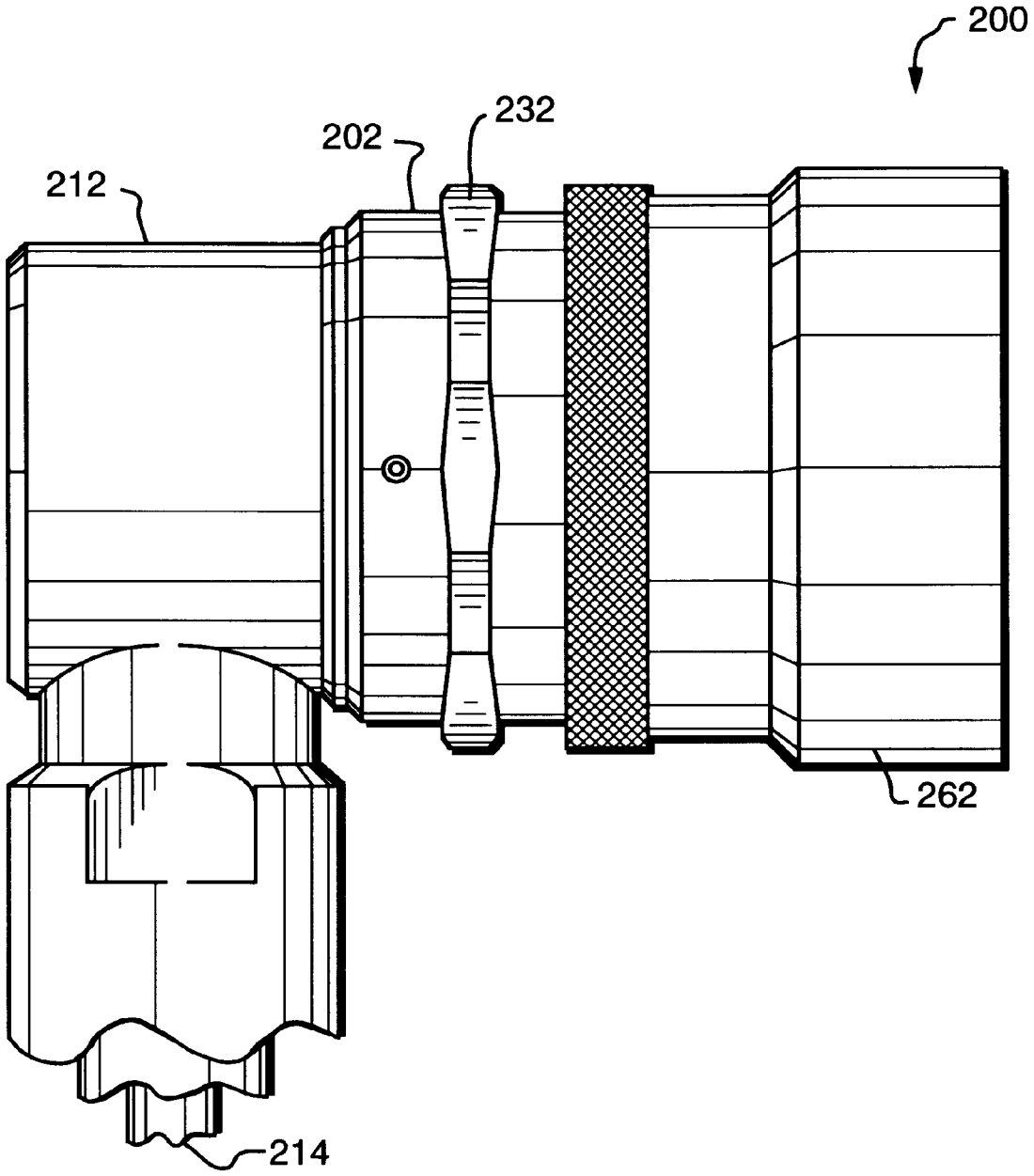
FIG. 3: is a side view of a mating connector with a right angle adaptor according to the present invention which is adapted for mating with the connector shown in FIG. 1.
Figure 4:
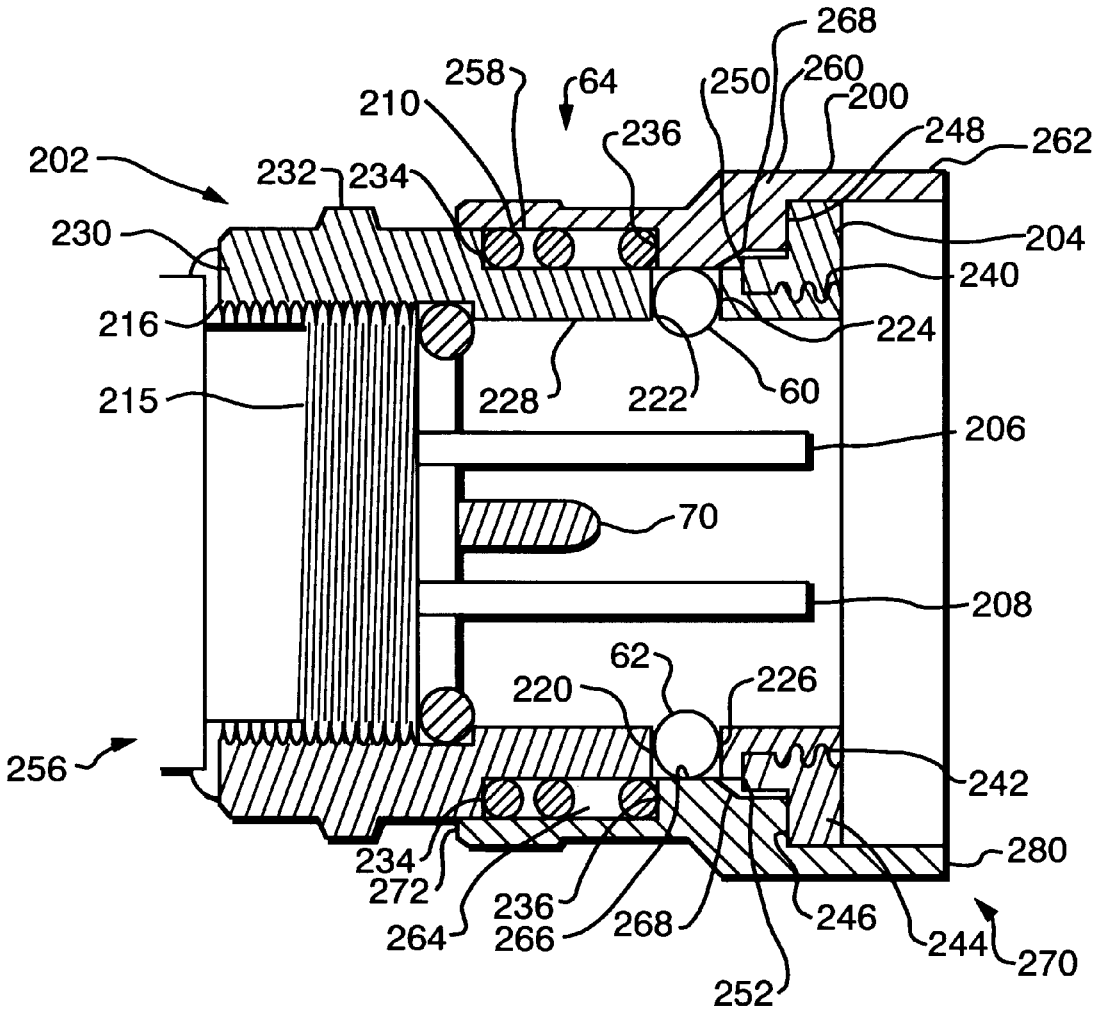
FIG. 4: is a sectional view of the mating connector shown in FIG. 3.

Turning now to FIGS. 3 and 4, a preferred embodiment of a mating connector 64 is shown having a coupling sleeve 200, a first inner shell 202, an end shell 204, insulator portions 206,208, a center conductor 70, a compression spring 210, and ball bearing locking elements 60,62. As shown, the center conductor 70 is disposed in a fixed axial position within an opening defined by the insulator portions and is electrically connected to a conductor 214 received within a known right angle adaptor 212. The right angle adaptor includes threads 215 on an end thereof which mate with threads 216 on an inner surface of the inner shell portion to secure the mating connector to the right angle adaptor.

The inner shell portion 202 is generally cylindrical in shape and is formed with portions defining openings 220, 222 in the walls thereof which are sized to receive the ball bearing locking elements. The portions defining the openings include a beveled inner surfaces 224, 226 which cause the diameter of the openings to diminish toward the inner surface 228 of the inner shell. The ball bearing locking elements, therefore, may be received within a top portion of the openings, but the bottom portion of the openings has a diameter which allows only a portion of the ball bearing locking elements to extend inward beyond the inner surface 228 thereof of the inner shell.

The inner shell portion includes an enlarged diameter portion 230 at a rear end thereof with a circumferential projection 232 on the exterior surface. A shelf 234 is formed on the exterior of the inner shell portion. The shelf provides a surface against which the bottom of the cylindrical compression spring 210 rests. The top of the compression spring engages a shelf 236 formed on the interior of the generally cylindrical coupling sleeve 200 which is disposed around the inner shell portion.

The end shell 204 includes threads 240 which mate with corresponding threads 242 on the end of the exterior surface of the inner shell. The end shell portion includes an enlarged diameter portion 244 which defines a shelf 246 for engaging an opposed shelf 248 on the interior surface of the coupling sleeve. In assembling the mating connector, the threads 240 on the end shell are mated with the threads 242 on the inner shell and the end shell is rotated relative to the inner shell until an end surface 250 of the end shell contacts a shelf 252 on the inner shell. As the end shell is threaded onto the inner shell, the shelf 246 on the end shell engages the opposed shelf 248 on the coupling sleeve to thereby force the coupling sleeve axially reward against the bias of the compression spring. The compression spring, therefore, continuously biases the coupling sleeve against the shelf 246 of the end shell by imposing a spring force against the shelf 236 on the interior surface of the coupling sleeve. The spring force of the compression spring is selected so that it may be overcome by physically forcing the coupling sleeve axially reward in the direction of end 256 of the mating connector.

The coupling sleeve includes a reduced diameter portion 258, an enlarged diameter portion 260 and a switch actuating portion 262. The inner surface of the reduced diameter portion, in connection with an opposed outer surface portion of the inner shell, defines a cavity 264 in which the compression spring is disposed. The enlarged diameter portion includes a first inner surface 266 which is normally positioned directly over the openings 220,222 in the inner shell in which the ball bearing locking elements are disposed. This first inner surface forces the ball bearings radially inward so that portions thereof extend radially inward beyond the inner surface 228 of the inner shell, as shown in FIG.4. A beveled inner surface 268 of the enlarge diameter portion is positioned adjacent the openings toward the end 270 of the connector.

Connection between the connector 1 and the mating connector 64 is established by retracting the coupling sleeve 200 toward end 256 of the mating connector and against the bias of the compression spring 210 until the end 272 of the coupling sleeve contacts the projection 232. This action brings the beveled inner surface 268 of the coupling sleeve into alignment with the openings 220,222, thereby allowing the ball bearing locking elements to recede inward relative to the inner surface 228 of the inner shell and against the beveled inner surface of the coupling sleeve.

Once the ball bearings are free to recede into the openings toward the outer shell and beyond the inner surface 228 of the inner shell, the mating connector is positioned over the end shell of the connector 1 until the locations of the ball bearings correspond axially with the location of the groove 36 in the end shell. Correspondingly, the center conductor 70 of the mating connector aligns with, and is received within, the center conductor of the connector 1 to create an electrical path through the connector 1 and the mating connector 1.

Figure 5:
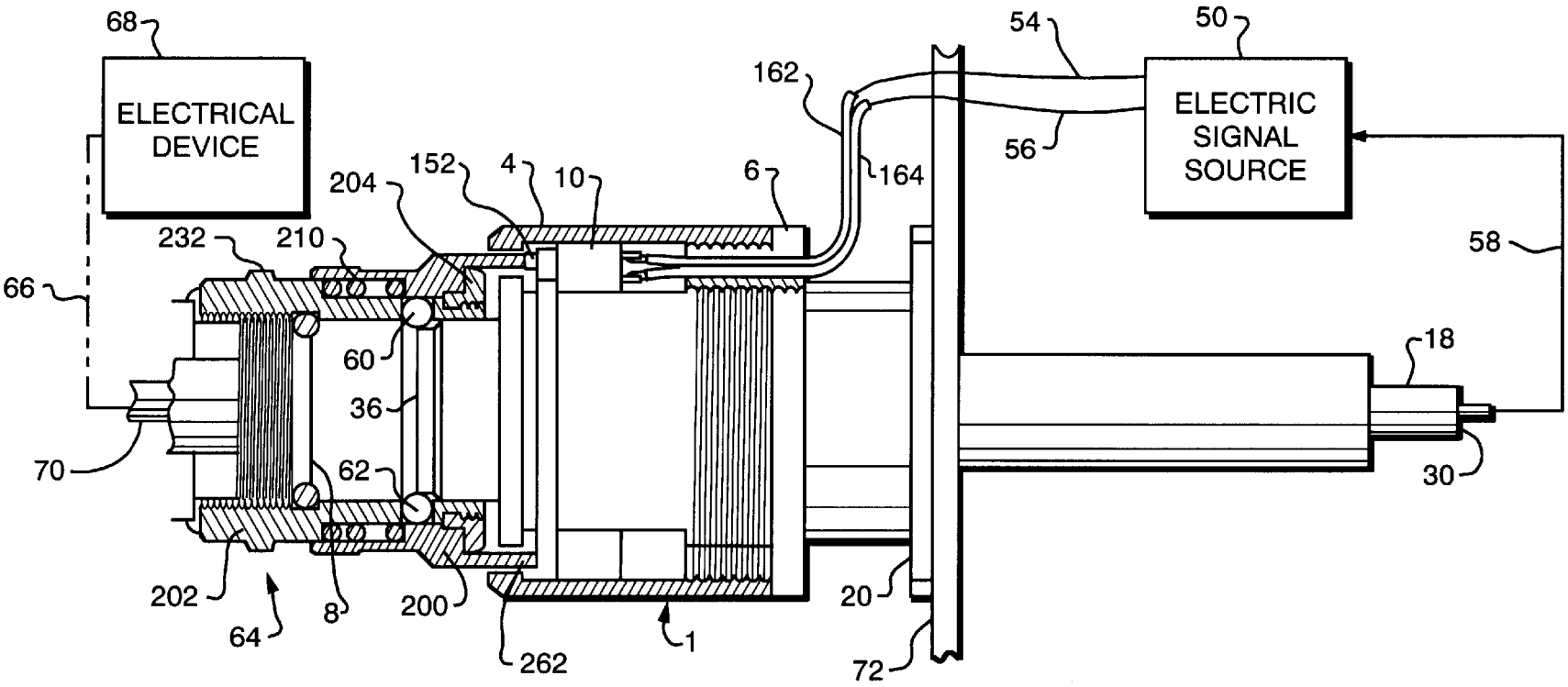
FIG. 5: is a partial sectional view showing the mating connection between the connector of FIG. 1 and the mating connector of FIG. 4

The coupling sleeve is then released and the compression spring forces the coupling sleeve in the direction of end 270 of the mating connector, thereby causing the first inner surface 266 of the coupling sleeve to force the bearings 60,62 outward relative to the inner surface 228 of the inner shell and into the groove 36 in the connector 1, as shown particularly in FIG. 5. The engagement of the ball bearings with the groove locks the mating connector 64 to the connector 1.

Advantageously, as the mating connector 64 is mated with the connector 1, the switch actuating portion 262 of the coupling sleeve extends into the opening 184 in the connector 1 in which the switch post 152 is disposed. The switch actuating portion is dimensioned so that when the mating connection is made, the end surface 280 of the switch actuating portion contacts the end of the switch post 152 and depresses the switch post to change the switch from an "open" state to a "closed" state.

Thus, the switch 10 is changed from a normally open state to a closed state upon connection of the mating connector to allow connection of an electrical signal source 50 to the center conductor 18. When the mating connector is withdrawn from the connector 1 by retracting the coupling sleeve, the switch actuating portion 262 of the coupling sleeve is removed from contact with the switch post 152, and the switch post returns to its position within the opening 184 to return the switch to its normally "open" state.

With this construction, it is possible to connect an electrical signal to the center conductor 18 of the connector 1 only when the connector 1 is mated with the mating connector 64. Accordingly, the end 26 of the center conductor 18 is never "hot" when it is disconnected from a mating connector. In addition, by positioning the end of the switch post 152 axially inward relative to the top surfaces of the outer shell 4 and end shell 8, the switch cannot be overridden by contact with a human finger or a blunt instrument.

There is thus provided an electrical connector which eliminates the hazards associated with providing a high power electrical signal to an unmated connector. The connector includes an internal micro switch disposed within the connector body for allowing connection of an electric signal source to the connector only when it is mated with a mating connector. The mating connector includes a switch actuating portion which extends into an opening formed in the connector to depress a post of the switch to change the switch from a normally "open" state to a "closed" state, thereby establishing an electrical connection between an electric signal source and the center conductor of the connector. Upon withdrawal of the mating connector the switch returns to its normally "open" state, thereby disconnecting the electrical connection between the center conductor of the connector and the electric signal source. The risks of personal injury or damage to equipment resulting from inadvertent contact with the end 26 of the center conductor, or from arcing of an electrical signal from the center conductor, are, therefore, eliminated in a simple and cost-effective design.

The embodiments which have been described herein, however, are but some of the several which utilize this invention and are set forth here by way of illustration but not of limitation. For example, any number of internal switches may be provided, and several component parts could be combined into unitary pieces. Also, it would be readily apparent to those skilled in the art that the features of the present invention could be incorporated into a wide variety of connector designs for switching any type of electrical signal. It is obvious that many other embodiments, which will be readily apparent to those skilled in the art, may be made without departing materially from the spirit and scope of this invention.

What is claimed is:

1. An electrical connector comprising:

a body; and a switch disposed within an annular cavity in said body adjacent an annular opening in said body, said switch having leads connected to an electric circuit for controlling connection of an electrical signal to a center conductor of said connector, wherein upon mating of said connector with a mating connector, a portion of said mating connector enters said annular opening and directly contacts said switch to change said switch from a normally open state, wherein connection of said electrical signal to said center conductor is interrupted, to a closed state, wherein said electrical signal is connected to said center conductor for allowing current flow through said center conductor to a center conductor of said mating connector.

2. An electrical connector according to claim 1, wherein said mating connector contacts an end of a post of said switch.

3. An electrical connector according to claim 1, wherein said body includes a bore therein leading from an exterior surface of said body to said annular cavity, said bore being adapted in size to receive conductors connected to said leads of said switch.

4. An electrical connector according to claim 1, wherein said body comprises a mating shell and an outer shell, and wherein said annular cavity is formed between said mating shell and said outer shell.

5. An electrical connector according to claim 4, wherein said switch is secured to a projection on said mating shell.

6. An electrical connector according to claim 5, wherein said switch is secured to said mating shell by engagement of threads on an interior surface of said projection and threads on an exterior surface of a portion of said switch.

7. An electrical connector comprising:

a body including an outer shell and a mating shell, said body having bore therein leading to an internal annular cavity defined by said outer shell and said mating shell; and a switch disposed within said annular cavity adjacent an annular opening in said body, said switch having leads connected to an electric circuit through conductors disposed in said bore for controlling connection of an electrical signal to a center conductor of said connector, wherein upon mating of said connector with a mating connector, a portion of said mating connector enters said annular opening and directly contacts said switch to change said switch from a normally open state, wherein connection of said electrical signal to said center conductor is interrupted, to a closed state, wherein said electrical signal is connected to said center conductor for allowing current flow through said center conductor to a center conductor of said mating connector.

8. An electrical connector according to claim 7, wherein said mating connector contacts an end of a post of said switch.

9. An electrical connector according to claim 7, wherein said switch is secured to a projection on said mating shell.

10. An electrical connector according to claim 7, wherein said switch is secured to said mating shell by engagement of threads on an interior surface of said projection and threads on an exterior surface of a portion of said switch.

11. A mating connector for an electrical connector having an internal switch disposed within an annular cavity and adjacent an annular opening in said connector for controlling connection of a center contact of said connector to an electrical signal, said mating connector comprising:

a body including a switch actuating portion, said switch actuating portion being dimensioned to extend axially from said body to enter said annular opening and contact said switch upon mating of said mating connector with said connector for thereby changing said switch from a normally open state, wherein connection of said electrical signal to said center conductor is interrupted, to a closed state, wherein said electrical signal is connected to said center conductor for allowing current flow through said center conductor to a center conductor of said mating connector.

12. A mating connector according to claim 11, wherein said body includes an inner shell portion and a coupling shell disposed about said inner shell, said coupling shell being axially biased toward a mating end of said mating connector by a compression spring disposed between said inner shell and said coupling shell;

and wherein an end of said coupling shell is said switch actuating portion.

13. A mating connector according to claim 12, wherein said inner shell includes portions defining openings, and wherein locking elements are disposed within said openings with portions thereof being forced radially inward beyond an inner surface of said inner shell by a first surface of said coupling shell, said coupling shell including a beveled surface adjacent said first surface, wherein upon axial movement of said coupling shell away from said mating end said beveled surface aligns with said openings thereby allowing said locking elements to recede within said openings against said beveled surface; and wherein said connector includes a groove formed therein for receiving said locking elements, said locking elements being forced into said groove by said first surface upon release of said coupling shell for thereby forming a mating connection between said mating connector and said connector.

14. A method of connecting of an electrical signal to an electrical connector upon mating of said connector with a mating connector comprising:

providing said electrical connector, said connector comprising:

a body; and a switch disposed within an annular cavity in said body adjacent an annular opening in said body, said switch having leads connected to an electric circuit for controlling connection of said electrical signal to a center conductor of said connector, wherein upon mating of said connector with said mating connector, said mating connector causes said switch to change from a normally open state, wherein connection of said electrical signal to said center conductor is interrupted, to a closed state, wherein said electrical signal is connected to said center conductor for allowing current flow through said center conductor to a center conductor of said mating connector; and mating said mating connector with said connector thereby causing said center conductor of said connector to contact said center conductor of said mating connector and causing a portion of said mating connector to enter said annular opening and directly contact said switch to change said switch from said normally open state to said closed state.

15. A method according to claim 14, wherein said mating connector contacts an end of a post of said switch.

16. A method according to claim 14, wherein said body includes a bore therein leading from an exterior surface of said body to said annular cavity, said bore being adapted in size to receive conductors connected to said leads of said switch.

17. A method according to claim 14, wherein said body comprises a mating shell and an outer shell, and wherein said annular cavity is formed between said mating shell and said outer shell.

18. A method according to claim 17, wherein said switch is secured to a projection on said mating shell.

* * * * *